US006321417B1

(12) United States Patent
Zhang

(10) Patent No.: US 6,321,417 B1
(45) Date of Patent: Nov. 27, 2001

(54) ERGONOMICAL TOOL HANDLE

(75) Inventor: Yong Ming Zhang, Barrington, RI (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/598,742

(22) Filed: Jun. 21, 2000

(51) Int. Cl.[7] ..... B25G 3/00; B25G 1/04

(52) U.S. Cl. ..... 16/430; 16/431; 16/DIG. 12; 81/177.1; 81/489

(58) Field of Search ..... 16/430, 436, 422, 16/DIG. 12, DIG. 19; D8/80, 107, 313, 303; D7/393, 395; D22/117, 118; 81/177.1, 177.3, 489; 74/551.8, 551.9; 473/538, 549, 568; 482/49, 50, 82, 106, 126

(56) References Cited

U.S. PATENT DOCUMENTS

| | | | | |
|---|---|---|---|---|
| D. 142,982 | | 11/1945 | Bloomfield . | |
| 1,559,097 | | 10/1925 | Hill . | |
| 1,940,693 | | 12/1933 | Pearson . | |
| 2,091,458 | * | 8/1937 | Sleight | 16/421 |
| 2,499,928 | | 3/1950 | Misic . | |
| 2,831,463 | * | 4/1958 | Ekstrom et al. | 16/431 |
| 3,203,697 | * | 8/1965 | Berzatzy | 16/430 |
| 3,880,443 | * | 4/1975 | Tobin | 16/DIG. 12 |
| 4,154,309 | | 5/1979 | Sappington . | |
| 4,196,761 | | 4/1980 | Roger . | |
| 4,523,498 | | 6/1985 | Chapman, Jr. . | |
| 4,750,760 | * | 6/1988 | Gurley | 16/DIG. 12 |
| 4,850,079 | * | 7/1989 | Thompson | 16/421 |
| 4,885,818 | * | 12/1989 | Arterbury | 16/430 |
| 4,895,044 | * | 1/1990 | Ekins | 16/430 |
| 5,273,120 | * | 12/1993 | Chang | 16/431 |
| 5,365,637 | * | 11/1994 | Bodell et al. | 16/431 |

FOREIGN PATENT DOCUMENTS

WO-98/48979 * 11/1998 (WO) .

* cited by examiner

*Primary Examiner*—Chuck Y. Mah
(74) *Attorney, Agent, or Firm*—Charles G. Lamb; Middleton Reutlinger

(57) ABSTRACT

The present invention provides an ergonomical handle for a power tool that reduces the risk of injury to an operator's wrist or forearm by redirecting torsional forces to the operator's upper arm and reducing the force provided by the tool operator necessary to resist the torque produced by the tool. The handle includes a concave channel and a means for attaching the handle to a tool adjacent to the barrel of the tool, such as an annular collar with a substantially elliptical outer diameter. In a preferred embodiment, the channel includes an inner side wall and an outer side wall that are curved in a nonparallel fashion so as to mirror the planar and dorsal sides of a hand. In use, a tool operator inserts a hand into the channel. The side walls of the channel frictionally engage the operator's hand so that the operator may operate the tool without gripping the barrel thereof.

17 Claims, 2 Drawing Sheets

ERGONOMICAL TOOL HANDLE

BACKGROUND

1. Field of the Invention

The invention relates generally to handles for tools, and more particularly to ergonomical handles for power driven tools.

2. Description of the Related Art

Hand-operated tools frequently use outside power sources, such as electricity and compressed air, to increase efficiency and productivity. However, the operation of such tools often subjects the operator to physical stresses caused by the forces generated by these power driven tools. Over time, the physical stresses a power driven tool operator encounters lead to physical maladies such as carpal tunnel syndrome. Current power driven tools are often not designed to redirect forces, such as torque, away from weaker parts of the operator's limbs to those body parts better able to absorb the forces, or to redistribute those forces over a wider area of the operator's limbs, thereby lessening the impact of those forces on any particular part of the operator's limbs. Furthermore, such current power driven tools also fail to optimize the moment arm between the axis of the barrel of the tool and the force applied by the operator's hand; the result of which is that the operator, in order to control the tool, most provide more force to overcome the torque generated by the power driven tool.

Therefore, there is a need for an ergonomically designed handle for power driven hand-operated tools that redistributes forces generated by the tools away from the weak points of an operator's limbs, and optimize the moment arm between the tool and the operator's hand, so as to reduce the force needed to resist the torque generated by the tool and to reduce the risk of injury to tool operators.

SUMMARY

It is an object of the present invention to provide a handle for a power driven tool that reduces the risk of injury to the operator caused by forces generated by the tool.

It is another object of the present invention to provide a handle for a tool that provides for the comfortable operation of the tool.

It is a further object of the present invention to provide a handle for a tool that is attachable to a tool not specifically designed to receive a handle.

It is yet another object of the present invention to provide a handle for a tool that allows an operator to control the tool without actually gripping the tool.

It is another object of the present invention to provide a handle for a tool that optimizes the moment arm between the tool and the operator's hand, so as to reduce the force provided by the operator to resist the torque generated by a power driven tool.

More particularly, the present invention provides a handle for a power driven tool that includes a body having a concave channel therein. The channel is so configured as to receive the operator's hand or portion thereof. The sidewalls of the concave channel are so configured as to mirror the palmar and dorsal dimensions of a hand. The handle is designed so as to engage frictionally the hand of the tool operator. The engagement of the operator's hand by the handle allows for the redistribution of torque and other forces generated by the tool away from the operator's wrist and forearm to the elbow and upper arm. The handle may also include a collar, sleeve or other portion that operates to attach the handle to a tool. Preferably, the outer diameter of the collar is substantially elliptical. This elliptical shape tends to extend the moment arm which lies between the axis of the barrel of the power tool and the point where force is applied by the operator's hand to resist the torque generated by the power tool. The elliptical design also directs more of the torque generated by the power tool in a direction normal to the palmer surface of the user's hand than would other shaped handles. The directing of the torque in a direction normal to the user's hand allows for the redistribution of the force away from the wrist and forearm to the upper arm of the user. The collar of the handle, with its substantially elliptical shape, allows for the effective operation of a power tool with less force applied by the operator than would otherwise be necessary. The handle may also be used in combination with a bushing that allows the handle to be used with tools with a variety of barrel diameters. Furthermore, the handle may be designed to be used in conjunction with either the right hand or the left hand and may be used on an electrically or pneumatically powered tool.

It will become apparent that other objects and advantages of the present invention will be obvious to those skilled in the art upon reading the detailed description of the preferred embodiment set forth hereinafter.

DESCRIPTION OF THE PREFERRED EMBODIMENT

Figure 2:
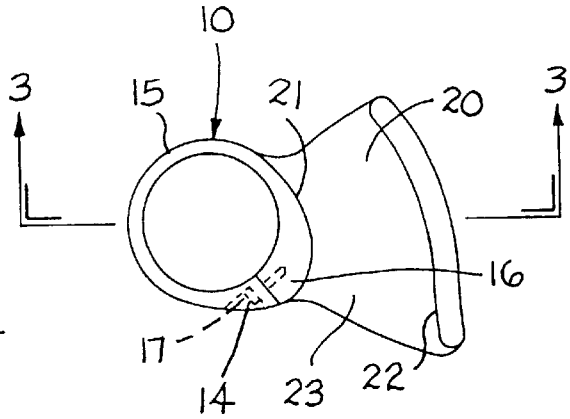
FIG. 2 is a top view of the handle of FIG.1 that is not attached to a power tool.

As shown in the figures, a tool handle 10 of the present invention is provided. The handle 10 includes a concave channel 20. The concave channel has curved sidewalls 21 and 22, as shown in FIG. 2. In the preferred embodiment shown in FIG. 2, sidewalls 21 and 22 are curved so as to conform generally to the shape at least a portion of the palmar and the dorsal sides of a hand, respectively. Handle 10 may be used in conjunction with a power tool that is electrically or pneumatically driven.

Figure 1:
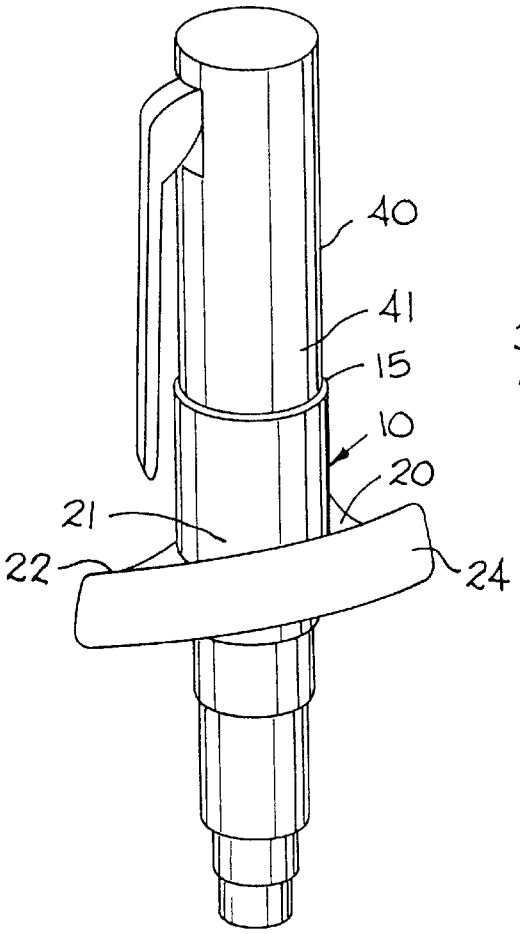
FIG. 1 is a perspective view of a preferred embodiment of the handle of the present invention attached to the barrel of a power tool.

As shown in FIG. 1, the handle 10 may be attached to the barrel 41 of a power driven tool 40, such as an air-powered screwdriver. FIG. 1 shows handle 10 releasably attached to the barrel or barrel portion 41 of screwdriver 40. In this embodiment, handle 10 includes a collar 15 which may be disposed on the barrel 41 of the tool 40. Collar 15 may be substantially elliptical, circular or any other convenient shape that allows for the attachment of the handle 10 to the barrel 41 of a tool. In the preferred embodiment, collar 15 has a substantially elliptical outer diameter and a substantially circular inner diameter, as shown in FIG. 2. The substantially elliptical outer diameter of collar 15 increases the length of the moment arm or lever arm, which is the perpendicular distance from the rotational axis to the line of action of the force applied by the operator to overcome the torque generated by the power tool. The increase in the moment arm provided by the elliptical collar 15 allows for the power tool 40 to be effectively operated with a reduced amount of force applied by the operator. Furthermore, the elliptical collar 15 directs torque in a direction normal to the palmar surface of the user's hand, thereby redistributing the force away from the user's wrist and forearm to the user's upper arm. Collar 15 may be tightened so as to engage frictionally barrel 41 by use of screws, hook-and-loop fasteners or any other fastening means well known in the art. Also, a bushing (not shown) may be inserted onto the barrel 41 of the power tool 40 and the collar 15 of the handle 10 may be attached to the tool over this bushing, thereby allowing a handle 10 to be used with a power tool 40 that has a barrel 41 with a smaller outer diameter than the inner diameter of the collar 15. The outer wall 22, having an outer surface 24 as shown in FIG. 1, projects upward from bottom wall 23. And, as shown in FIG. 2, outer wall 22 has a length greater than the outer diameter of collar 15.

Handle 10 may be formed of any durable material well known in the art, such as metal or plastic. The inner surface of channel 20 may be lined with a pliant material, such as a polymer foam, that both deforms to the shape of a hand received within the channel and frictionally engages the hand, so that the operator need not grip the tool or the handle in order to operate the tool. Alternatively, the inner surface of channel 20 may be lined with a material, such as a powder coating, that has a higher coefficient of friction than the material from which the handle 10 is formed. Such a material can provide greater friction between the handle 10 and the operator's hand, while also providing a comfortable feel for the operator. Any liner material used in channel 20 should increase the friction between the handle 10 and the operator's hand, as well as provide a comfortable feel for the operator. The handle 10 may be releasably attached to a tool or integrally formed therewith. It is contemplated that the handle 10 may be used with any tool, manual or power driven, whose operation, in the absence of the handle 10, would subject the operator's hands and arms to torsional forces that could cause physical injury.

As shown in FIG.2, the channel 20 of handle 10 may extend around the portion of circumference of the barrel of a tool (not shown). In this embodiment, outer side wall 22 and inner side wall 21 are curved in a nonparallel fashion so that they generally mirror the curvature of the dorsal and planar sides of a hand. The nonparallel curvatures of the side walls 21 and 22 provide for a comfortable grip for the hand of the tool operator. Additionally, these curved side walls reduce stress and fatigue in the operator's hand and arm. Collar 15 is generally annular and has one or more screws 17, shown in phantom lines, threadably disposed within the body thereof to join the ends 14 and 16 thereof.

Figure 3:
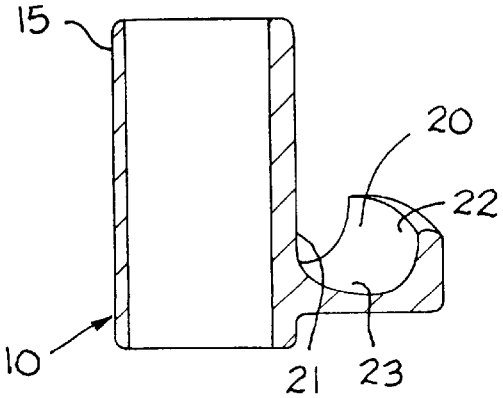
FIG. 3 is a cross sectional view of the handle of FIG. 2 taken along line 3—3.
Figure 4:
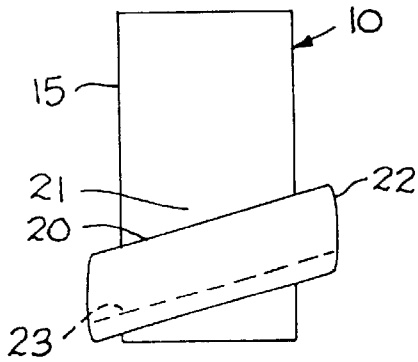
FIG. 4 is a side view of the handle of FIG. 2.

As shown in FIG. 3, the outer side wall 22 is generally shorter than inner side wall 21. Also, bottom wall 23 may include a flat portion in addition to the rounded portions that meet side walls 21 and 22. Channel 20 may also be angled, as shown in FIG. 3 and FIG. 4. The channel 20 may be sloping at any angle less than 90° relative to the axis of collar 15, which provides for a comfortable operation of the tool and reduces or redistributes the forces directed at the wrist and forearm of the tool operator. A preferred embodiment, as shown in FIG. 4, includes a channel 20 that slopes 15° relative to a plane perpendicular to the axis of the barrel of the tool, not shown, to which the handle 10 is attached. Furthermore, channel 20 may be sloping at different angles at different points within the channel. For example, the ends of channel 20 may slope at 0° and a middle portion of the same channel may slope at 30°.

Figure 5:
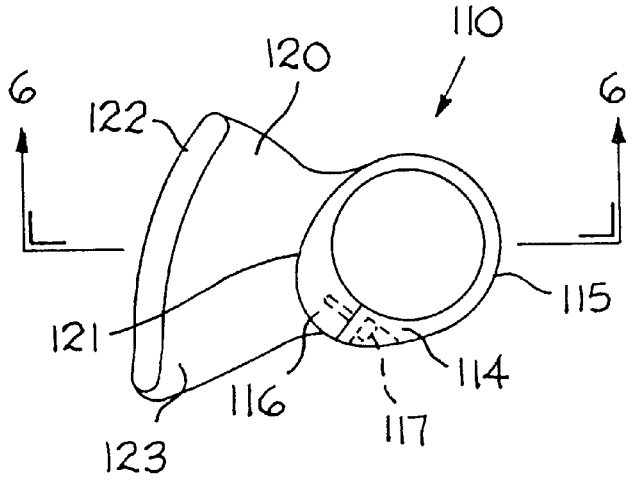
FIG. 5 is a top view of another embodiment of the handle of the present invention.
Figure 6:
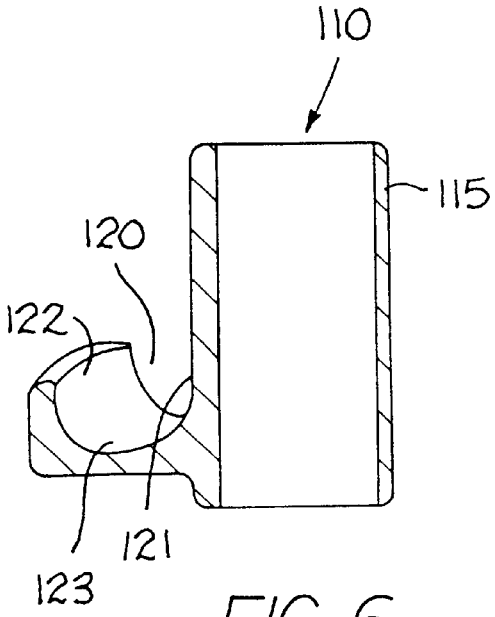
FIG. 6 is a cross sectional view of the handle of FIG. 5 taken along line 6—6.
Figure 7:
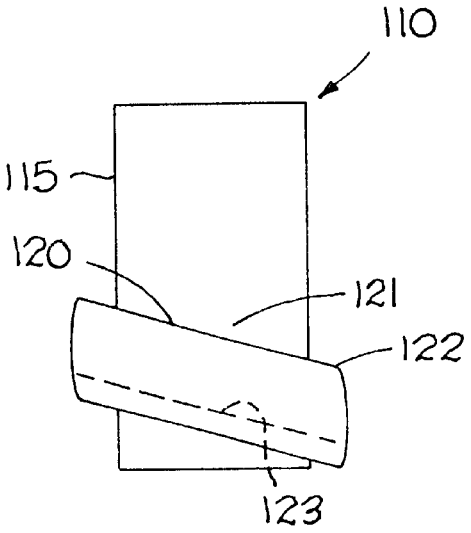
FIG. 7 is a side view of the handle of FIG. 5.

As shown in FIGS. 5–7, the handle 110 of the present invention may be configured for a left-handed tool operator. FIG. 5 shows the handle 110 as a mirror image of the handle 10 shown in FIG. 2. Inner side wall 121 and outer side wall 122 are curved so as to mirror at least a portion of the palmar and the dorsal sides of a hand. As with handle 10, handle 110 for left-handed operation of the tool may include a channel 120, or portion thereof, that slopes at any angle over a range of 0–90°.

As previously mentioned, handle 10 may be provided by the present invention without a collar 15 that may be disposed around the barrel of a tool. In this case, handle 10 may be integrally attached to the tool with which it is to be used. For example, the handle 10 may be made of molded plastic that is incorporated into the molded barrel of the tool. Alternatively, the handle 10 may be attached to the barrel of a tool by the use of screws, pins or similar devices that are threaded through a portion of the handle and into the barrel or other part of a tool. In a preferred embodiment of a handle 10 that does not have a collar 15, a substantially elliptical surface will be provided by the combination of the handle 10 and the barrel of the tool, not shown. This elliptical surface, adjacent to which is the operator's hand when disposed within the handle 10, provides the same advantages as those provided by the substantially elliptical outer diameter of the collar 15 and describe above.

In use, the operator's hand is placed into the concave channel 20 with the palm facing the barrel 41 of the tool 40. The sidewalls 21 and 22 frictionally engage the hand during operation of the tool so that the operator may direct the tool 40 without gripping the barrel 41. When the tool 40 is operated, some or all of the torque and other forces generated by the tool 40 are redirected to the operator's upper arm, which is generally stronger than the wrist and forearm and, therefore, better able to absorb those forces. Since the operator need not grip the tool 40, the operator's wrist and forearm do not absorb all of the energy transmitted by the tool 40. Furthermore, the operator may effectively operate the power tool 40 by applying less force to resist the torque produced by the tool than otherwise would be needed in the absence of the handle 10. Thus, the risk of injury and fatigue caused by operating the tool is reduced or eliminated.

While the invention has been found in the preferred embodiments disclosed herein, it is apparent that various modifications can be made to the present invention without departing from the spirit or scope as set forth in the claims appended hereto.

What is claimed is:

1. A handle for a tool comprising:

a body including a channel therein for receiving at least a portion of a hand, wherein said channel is adjacent to a barrel portion of a tool when said body is attached to said tool, said channel including a bottom wall, an outer side wall and an inner side wall, wherein said inner side wall is curved in the shape of at least a portion of the palmar side of a hand, and said outer side wall is curved in the shape of at least a portion of the dorsal side of a hand, said inner side wall and said outer side wall being adapted to engage said hand;

a collar integral with said body, said collar for attaching said handle to said tool, said outer side wall having a length greater than an outer diameter of said collar.

2. The handle of claim 1, wherein said tool is a pneumatically powered tool.

3. The handle of claim 1, wherein said tool is an electrically powered tool.

4. The handle of claim 1, wherein said collar is annular.

5. The handle of claim 1, wherein said collar includes a substantially elliptical outer diameter.

6. The handle of claim 5, wherein said collar includes a substantially circular inner diameter.

7. The handle of claim 1, wherein said collar further includes at least one screw threadably disposed within said collar to secure said handle to said barrel.

8. The handle of claim 1, being formed of a metal.

9. The handle of claim 1, being formed of a plastic.

10. The handle of claim 1, wherein said channel includes a deformable material disposed therein.

11. The handle of claim 10, wherein said deformable material includes a polymer foam.

12. The handle of claim 1, wherein said handle includes a powder coating thereon.

13. The handle of claim 1, wherein at least a portion of said channel slopes at an angle relative to an axis of said barrel of said tool.

14. The handle of claim 13, wherein said angle is less than 90°.

15. The handle of claim 1, wherein said outer side wall is not parallel to said inner side wall.

16. An ergonomical handle for a power tool comprising:

a body portion including a channel therein for receiving a hand, wherein said channel is adjacent to a barrel portion of a tool when said body is attached to said tool, said channel including a bottom wall, an outer side wall and an inner side wall, wherein said inner side wall is curved in the shape of at least a portion of the palmar side of a hand, and said outer side wall is curved in the shape of at least a portion of the dorsal side of a hand, said inner side wall and said outer side wall being adapted to engage said hand disposed in said channel, said channel sloping at an angle relative to an axis of said barrel portion of said tool; and, a collar having a substantially elliptical outer diameter, said outer wall having a length greater than said outer diameter of said collar.

17. The ergonomical handle of claim 16, wherein said angle is less than 90°.

* * * * *